US006541420B2

(12) United States Patent
Yamamoto et al.

(10) Patent No.: US 6,541,420 B2
(45) Date of Patent: Apr. 1, 2003

(54) HEAT TRANSFER SHEET

(75) Inventors: Mitsuru Yamamoto, Shizuoka-ken (JP); Toshiharu Tanaka, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 93 days.

(21) Appl. No.: 09/782,054

(22) Filed: Feb. 14, 2001

(65) Prior Publication Data

US 2001/0023013 A1 Sep. 20, 2001

(30) Foreign Application Priority Data

Feb. 17, 2000 (JP) ..... 2000-039500

(51) Int. Cl.[7] ..... B41M 5/035; B41M 5/38; B41M 5/40

(52) U.S. Cl. ..... 503/227; 428/195; 428/913

(58) Field of Search ..... 428/195, 913, 428/914; 503/227

(56) References Cited

U.S. PATENT DOCUMENTS 5,725,989 A * 3/1998 Chang et al. ..... 430/201
5,746,866 A * 5/1998 Tanaka et al. ..... 156/234
5,762,743 A * 6/1998 Nakamura ..... 156/235
6,228,555 B1 * 5/2001 Hoffend et al. ..... 430/200

FOREIGN PATENT DOCUMENTS

| | | |
|---|---|---|
| JP | 5-169861 | 7/1993 |
| JP | 9-76637 | 3/1997 |
| JP | 11-321099 | 11/1999 |

OTHER PUBLICATIONS

Patent Abstract of Japan, 05–169861, Jul. 9, 1993.

Patent Abstract of Japan, 11–321099, Nov. 24, 1999.

Patent Abstract of Japan, 09–076637, Mar. 25, 1997.

* cited by examiner

*Primary Examiner*—Bruce H. Hess
(74) *Attorney, Agent, or Firm*—Sughrue Mion, PLLC

(57) ABSTRACT

A heat transfer sheet comprising a light-heat conversion layer having an infrared absorption colorant and an image forming layer sequentially disposed on a support, wherein an optical density in a 600 nm to 1000 nm range of the light-heat conversion layer is within a range of 0.3 to 2.0.

13 Claims, No Drawings

HEAT TRANSFER SHEET

BACKGROUND OF THE INVENTION

1. Field of the Invention

The present invention relates to a heat transfer sheet which can be used for wide range laser recording devices, and with which a transfer image having no deterioration in image quality due to fogging and the like can be obtained.

2. Description of the Related Art

Carbon black, which has absorption in a wide wavelength range, has frequently been used as a light-heat conversion substance included in a light-heat conversion layer of a heat transfer sheet because it can be accommodated to various laser recording devices, as disclosed in Japanese Patent Application Laid-Open (JP-A) No. 5-169861, JP-A No. 9-76637, and JP-A No. 11-321099.

However, because there is a tendency for fine particles of carbon black to agglomerate at the time of application, there has been the possibility for the quality of the transfer image to deteriorate. Further, there has been the possibility for the carbon black to be transferred to the material to which transfer is made due to fusion and ablasion at the time of recording, thus generating fogging and lowering image quality.

SUMMARY OF THE INVENTION

The present invention has been devised in consideration of the above facts. An object of the present invention is to provide a heat transfer sheet which can be accommodated to laser recording devices of varied wavelengths but which does not lower the image quality of a transfer image.

In order to solve the above problems, the present invention provides a heat transfer sheet comprising a light-heat conversion layer having an infrared absorption colorant and an image forming layer sequentially disposed on a support, wherein an optical density in a 600 nm to 1000 nm range of the light-heat conversion layer is within a range of 0.3 to 2.0.

DESCRIPTION OF THE PREFERRED EMBODIMENTS

The present invention will hereinafter be described in detail.

The heat transfer sheet of the present invention has on a support a light-heat conversion layer and an image forming layer in this order. As long as the support has good dimensional stability and can withstand heat at the time of image formation, anything may be used. Specifically, the film or the sheet disclosed at the lower left column of page 2, lines 12 to 18 of Japanese Patent Application Laid-Open (JP-A) No. 63-193886 can be used.

Further, if an image is to be formed by irradiating a laser from the support side, it is preferable that the support is transparent. If an image is to be formed by irradiating a laser from the image forming layer side, it is not particularly necessary for the support to be transparent.

The support may have a cushion property in order to raise adhesion with the material to which transfer is made. In this case, it is favorable if a material having a low elastic modulus or a material having rubber elasticity is used. Specifically, examples include an elastomer such as natural rubber, acrylate rubber, butyl rubber, nitrile rubber, butadiene rubber, isoprene rubber, styrene-butadiene rubber, chloroprene rubber, urethane rubber, silicone rubber, acrylic rubber, fluorine-contained rubber, neoprene rubber, chlorosulfonated polyethylene, epichlorohydrine, EPDM, urethane elastomer; and resins having a small modulus of elasticity among polyethylene, polypropylene, polybutadiene, polybutene, impact resistant ABS resin, polyurethane, ABS resin, acetate, cellulose acetate, amide resin, polytetrafluoroethylene, nitro-cellulose, polystyrene, epoxy resin, phenol-formaldehyde resin, polyester, impact resistant acrylic resin, styrene-butadiene copolymer, ethylene-vinyl acetate copolymer, acrylonitrile-butadiene copolymer, vinyl chloride-vinyl acetate copolymer, polyvinyl acetate, plasticizer-added vinyl chloride resin, vinylidene chloride resin, polyvinyl chloride, and polyvinylidene chloride. Further, a shape-memory resin such as a styrene hybrid polymer, in which polynorbornene or a polybutadiene unit and a polystyrene unit have been compounded, may also be used.

A material having a low modulus of elasticity as described above or a material having rubber elasticity may also be combined in the base material of the support.

Although there are no particular restrictions on the thickness of the support, the thickness is generally 2 $\mu$m to 300 $\mu$m and preferably 5 $\mu$m to 200 $\mu$m. Although the thickness of a support having a cushion property varies in accordance with a number of factors such as the type of resin or elastomer to be used, the suction force at the time of adhesion, the particle diameter of the mat material, and the amount of mat material to be used, it is ordinarily 10 $\mu$m to 100 $\mu$m.

At the side of the support opposite the side provided with a light-heat conversion layer, a backcoat layer may be provided in order to endow the support with such functions as motion stability, heat resistance, and an antistatic property.

The backcoat layer can be formed by applying on the surface of the support a coating liquid for the backcoat layer obtained by dissolving in a solvent a resin such as nitrocellulose or a coating liquid for the backcoat layer obtained by dissolving or dispersing in a solvent a binder resin and 20 $\mu$m to 30 $\mu$m fine particles.

A cushion layer may be disposed on the support under the light-heat conversion layer. The cushion layer may not be necessary if the support has a cushion property. When dimensional stability is required or when materials having a low modulus of elasticity are used, it is preferable to dispose a cushion layer on a support without a cushion property rather than forming a support having a cushion property. Materials cited for the purpose of forming a support with a cushion property can be used as the materials for the cushion layer.

Although the thickness of the cushion layer varies in accordance with a number of factors such as the type of resin or elastomer to be used, the suction force at the time of adhesion, the particle diameter of the mat material, and the amount of mat material to be used, it is usually 10 $\mu$m to 100 $\mu$m.

The cushion layer can be formed by applying a coating liquid in which the material is dissolved or dispersed like a latex in one of various types of solvents by coating methods such as a blade coater, a roll coater, a bar coater, a curtain coater, or a gravure coater, or by an extrusion lamination method or the like.

By providing a cushion layer, adhesion is improved but the time required for decompression when vacuum adhesion is performed does not change much, and a sudden decompression triggers the generation of air pockets. In order to sufficiently ensure adhesion and reduce the time required for vacuum adhesion, it is preferable to roughen the heat transfer sheet.

As a method of roughening the heat transfer sheet, the surface of the cushion layer may be subjected to a roughening treatment, in advance, and then the light-heat conversion layer and the image forming layer are disposed thereon. A method in which a mat material is incorporated in the surface of the heat transfer sheet may also be employed.

The degree to which the cushion layer is roughened is determined in accordance with the elasticity of the cushion layer, film thickness, pressure applied (degree of vacuum), the surface roughness of the heat transfer sheet, the particle diameter of the mat material, and the amount of the mat material.

Roughening the surface of the cushion layer is also dependent upon the materials which form the cushion layer, but the surface roughness Ra is preferably of a range of 0.3 μm to 10 μm. A similar range is preferable when roughening the surface of the heat transfer sheet.

An infrared absorption pigment is used as a light-heat conversion substance in the light-heat conversion layer. Examples of infrared absorption pigments which can used include phthalocyanine pigments, naphthalocyanine pigments, squalilium pigments, indorenin dyes, cyanine dyes, nitroso compounds and their metallic complex salts, polymethine pigments, thiol-nickel salts, triallyl methane pigments, immonium pigments, naphthoquinone pigments, anthraquinone dyes, anthracene pigments, azulene pigments and the like. Specifically, compounds disclosed in the following can be used: JP-A No. 62-87388, JP-A No. 63-264395, JP-A No. 63-319191, JP-A No. 64-33547, JP-A No. 1-160683, JP-A No. 1-280750, JP-A No. 1-293342, JP-A No. 2-2064, JP-A No. 2-2074, JP-A No. 3-26593, JP-A No. 3-30991, JP-A No. 3-30992, JP-A No. 3-34891, JP-A No. 3-36093, JP-A No. 3-36094, JP-A No. 3-36095, JP-A No. 3-42281, JP-A No. 3-63185, JP-A No. 3-97589, JP-A No. 3-97590, JP-A No. 3-97591, 3-103476, JP-A No. 3-124488, JP-A No. 3-132391, JP-A No. 4-140191, JP-A No. 4-161382, JP-A No. 4-169289, JP-A No. 4-169290, JP-A No. 4-173290, JP-A No. 4-173291, JP-A No. 5-32058, JP-A No. 5-201140, JP-A No. 5-221164, JP-A No. 5-338358, JP-A No. 6-24143, JP-A No. 6-32069, JP-A No. 6-115263, JP-A No. 6-210987, JP-A No. 6-255271, JP-A No. 6-309695, JP-A No. 7-101171, JP-A No. 7-149049, JP-A No. 7-172059, JP-A No. 7-195830, JP-A No. 9-58143, JP-A No. 9-80763, JP-A No. 10-207065, JP-A No. 10-268512, JP-A No. 11-95026, and JP-A No. 11-302610. It is preferable that the light-heat conversion layer contains two or more types of infrared absorption pigments.

General heat-resistant resins which have a high glass transition point and high thermal conductivity such as methyl polymethacrylate, polycarbonate, polystyrene, ethyl cellulose, nitrocellulose, polyvinyl alcohol, polyvinyl chloride, amide resin, polyimide, polyether imide, polysulfone, polyethersulfone, aramide and the like may be used for the binder in the light-heat conversion layer. Among these resins, polyvinyl alcohol is preferable in particular because scattering of the light-heat conversion layer becomes difficult to occur.

The film thickness of the light-heat conversion layer is 0.1 μm to 3 μm. It is necessary that the optical density of the light-heat conversion layer at a wavelength of 600 nm to 1100 nm is 0.3 to 2.0. If the optical density is less than 0.3, irradiated light cannot be converted into heat. If the optical density exceeds 2.0, the light-heat conversion layer is destroyed and fogging is generated.

The image forming layer in the present invention refers to a layer which is melted or softened at the time of heating and is transferred to the material to which the layer is to be transferred, and contains a coloring material, a binder and the like. The image forming layer does not have to be transferred in a completely melted state.

Examples of the coloring material include inorganic and organic pigments and dyes. Examples of inorganic pigments include titanium dioxide, carbon black, zinc oxide, Prussian blue, cadmium sulfide, iron oxide, and chromates of lead, zinc, barium and calcium.

Examples of organic pigments include azo, thioindigo, anthraquinone, anthoanthrone, and triphenedioxazine pigments, vat dye pigments, phthalocyanine pigments such as copper phthalocyanine and derivatives thereof, and quinacridone pigments. Examples of organic dyes include acid dyes, direct dyes, disperse dyes, oil soluble dyes, oil soluble dyes containing metal, sublimation pigments and the like. Conventional, well-known sublimation pigments can be used. In the present invention, the term sublimation pigment includes heat-sublimation pigments. Examples of sublimation pigments include cyan pigments, magenta pigments and yellow pigments. Examples of cyan pigments include the naphthoquinone pigments, anthraquinone pigments, azomethine pigments and the like which are disclosed in JP-A No. 59-78896, JP-A No. 59-227948, JP-A 60-24966, JP-A No. 60-53563, JP-A No. 60-130735, JP-A No. 60-131292, JP-A No. 60-239289, JP-A No. 61-19396, JP-A No. 61-22993, JP-A No. 61-31292, JP-A No. 61-31467, JP-A No. 61-35994, JP-A No. 61-49893, JP-A No. 61-148269, JP-A No. 62-191191, JP-A No. 63-91288, JP-A No. 63-91287, and JP-A No. 63-290793.

Examples of the magenta pigments include the anthraquinone pigments, azo pigments, azomethine pigments and the like which are disclosed in JP-A No. 59-78896, JP-A No. 60-30392, JP-A No. 60-30394, JP-A No. 60-253595, JP-A No. 61-262190, JP-A No. 63-5992, JP-A No. 63-205288, JP-A No. 64-159, and JP-A No. 64-63194.

Examples of the yellow pigments include the methine pigments, azo pigments, quinophthalone pigments, anthraisothiazol pigments and the like which are disclosed in JP-A No. 59-78896, JP-A No. 60-27594, JP-A No. 60-31560, JP-A No. 60-53565, JP-A No. 61-12394, and JP-A No. 63-122594.

Examples of sublimation pigments which are particularly preferable include: an azomethine pigment obtained by a coupling reaction between a compound which has an open-chain or closed-chain active methylene group and an oxidated p-phenylenediamine derivative or an oxidated p-aminophenol derivative; and an indoaniline pigment obtained by a coupling reaction between a phenol or a naphthol derivative and an oxidated p-phenylenediamine derivative or an oxidated p-aminophenol derivative.

If the image to be formed is monochromatic, the sublimation pigment incorporated in the image forming layer may be a yellow pigment, a magenta pigment, or a cyan pigment. The amount of the coloring material in the image forming layer is ordinarily within a range of 5 wt. % to 70 wt. %, and preferably within a range of 10 wt. % to 60 wt. %.

Examples of the binder include heat-fusion substances, heat-softener substances, and thermoplastic resins. The heat-fusion substance is ordinarily a solid or semi-solid substance which has within a range of 40° C. to 150° C. a measured melting point.

Specific examples of the heat-fusion substances include the following types of waxes: vegetable waxes such as carnauba wax, Japan wax, and espar wax; animal waxes such as bees wax, insect wax, shellac wax, and whale wax; petroleum waxes such as paraffin wax, microcrystalline wax, polyethylene wax, ester wax and acid wax; and mineral waxes such as montan wax, ozocerite wax and ceresine. In addition to these types of waxes, specific examples of the heat-fusion substances include: higher fatty acids such as palmitic acid, stearic acid, margaric acid, behenic acid and the like; higher alcohol such as parimityl alcohol, stearyl alcohol, behenyl alcohol, marganyl alcohol, myricyl alcohol, eicosanol and the like; higher fatty acid esters such as cetyl palmitate, myricyl palmitate, cetyl stearate, myricyl stearate and the like; amides such as acetamide, propionic acid amide, palmitic acid amide, stearic acid amide, amide wax and the like; and higher amines such as stearyl amine, behenyl amine, palmityl amine and the like. These may be used singly or in combination.

Specific examples of the heat-softener substances include types of wax such as vegetable waxes, animal waxes, petroleum waxes, mineral waxes and the like, higher fatty acids, higher alcohols, higher fatty acid esters, amides, higher amines and the like. Further, amorphous organic polymers having a softening point of 40° C. to 150° C. are also preferable. Examples of such amorphous organic polymers include butyral resin, polyamide resin, polyethylene imine resin, sulfonamide resin, polyester ployol resin, petroleum resin, homopolymers and copolymers of styrenes and their derivatives, such as styrene, vinyl toluene, α-methylstyrene, 2-methylstyrene, chlorostyrene, vinyl benzoic acid, sodium vinyl benzenesulfonate, aminostyrene, homopolymers or copolymers with other monomers of vinyl monomers such as methacrylic acids and methacrylic acid ester (e.g., methyl metacrylate, ethyl metacrylate, butyl metacrylate, and hydroxyethyl metacrylate), acrylic acids and acrylic acid esters (e.g., methyl acrylates, ethyl acrylates, butyl acrylates, and α-ethylhexyl acrylates), diene (e.g., butadiene, isoprene), acrylonitrile, vinyl ether, maleic acids and maleic acid esters, maleic anhydrides, cinnamic acid, vinyl chloride, and vinyl acetate.

Examples of the thermoplastic resins are high molecular compounds having a softening point of 50° C. to 150° C. including resins such as ethylene copolymers, polyamide resins, polyester resins, polyurethane resins, polyolefin resins, acrylic resins, vinyl chloride resins, cellulose resins, rosin resins, ionomer resins and petroleum resins; elastomers such as natural rubber, styrene-butadiene rubber, isoprene rubber, and chloroprene rubber; rosin derivatives such as ester gum, rosin-maleic acid resin, rosin-phenol resin, hydrorosin and the like; and phenol resin, terpene resin, cyclopentadiene resin and aromatic hydrocarbon resin.

Of these binders, it is preferable to use an amorphous organic macromolecular polymer having a softening point of 40° C. to 150° C. The amounts of pigment and amorphous organic macromolecular polymer within the image forming layer are preferably each 20 wt. % to 80 wt. %.

In addition to the components cited above, the image forming layer may also include a surfactant, inorganic or organic particles (metallic powder, silica gel or the like), and an oil (linseed oil, mineral oil or the like). Excluding cases in which a black image is to be obtained, by incorporating in the image forming layer a substance which absorbs the wavelength of the light source used in image recording, the amount of energy necessary for transfer can be decreased. Pigments or dyes may be used as the substance which absorbs the wavelength of the light source. However, when a multi-colored image is to be obtained, in terms of color rendering it is preferable that an infrared light source such as a semiconductor laser or the like is used in image recording, and that a dye having a low absorption for visible portions and a large absorption for the wavelength of the light source is used. An example of a near-infrared dye includes the compound disclosed in JP-A No. 3-103476.

When the support has a cushion property, or when a non-roughened cushion layer is disposed on the support, it is preferable that a mat material is added to the image forming layer and that the surface thereof is roughened. Examples of the mat material include inorganic particulates and organic particulates. Examples of the inorganic particulates include silica, titanium oxide, aluminum oxide, zinc oxide, magnesium oxide, barium sulfate, magnesium sulfate, aluminum hydroxide, magnesium hydroxide, metallic salt such as boron nitride, kaolin, clay, talc, zinc white, lead white, zeeklite quartz, diatomaceous earth, pearlite, bentonite, mica and synthetic mica. Examples of the organic particulates include resin particulates such as fluorine-contained resin particulates, guanamine resin particulates, acrylic resin particulates, styrene-acrylic copolymer resin particulates, silicone resin particulates, melamine resin particulates and epoxy resin particulates.

At the time of image transfer, when the heat transfer sheet and the material to which the transfer is made are overlaid and pressure is applied or heat and pressure are applied thereto, if the heat transfer sheet includes a mat material which is crushed due to the pressure, a cushion property can be obtained even if the support does not have a cushion property or a cushion layer is not provided.

Examples of the mat material which is crushed at the time pressure is applied include particulates formed by materials having rubber elasticity. Specifically, examples include elastomers such as acrylate rubber, butyl rubber, nitrile rubber, butadiene rubber, isoprene rubber, styrene-butadiene rubber, chloroprene rubber, urethane rubber, silicone rubber, acrylic rubber, fluororubber, neoprene rubber, chlorosulfonated polyethylene, epichlorohydrin, and EPDM. Particulates made from waxes having a low hardenability such as paraffin wax, bees wax, wax having a high oil content, and wax having a high number of low molecular weight components may be used as the mat material which is crushed when heat and pressure are applied. The heat transfer sheet which is roughened by the wax particulates can be produced by forming the sheet at a temperature at least 10° C. lower than the melting initiation temperature of the wax forming the particulate.

The particle diameter of the mat material is ordinarily 0.3 μm to 30 μm, and preferably 0.5 μm to 20 μm. The amount of the mat material is 0.1 mg/m$^2$ to 100 mg/m$^2$.

The thickness of the image forming layer is ordinarily within a range of 0.1 μm to 0.3 μm, and preferably within a range of 0.2 μm to 1.5 μm.

When using a high density energy such as a laser as the light source, a scatter-prevention layer may be provided in order to prevent scattering due to heat generated by the light-heat conversion substance or the binder due to the light-heat conversion layer abruptly absorbing light energy and becoming exothermic. It is desirable that the scatter-prevention layer is a thin film and has a strength which can suppress the scattering of the light-heat conversion layer and is formed of a material having a high thermal conductivity such that it can rapidly conduct heat generated at the light-heat conversion layer to the image forming layer. The scatter-prevention layer is formed of general heat-resistant resins or the like similar to the light-heat conversion layer binder. Among these, polyvinyl alcohol is preferable in that it is effective in preventing scatter, is soluble in water and can be used in coating, and mixture of the image forming layer with the light-heat conversion layer is slight. Further, when light is irradiated from the side of the support of the heat transfer sheet, the scatter-prevention layer may be opaque, and metallic deposit films such as aluminum and the like are also effective in preventing scatter.

The thinner the film of the scatter-prevention layer is, the higher sensitivity is, and the thicker the film of the scatter-prevention layer is, the greater the effectiveness in preventing scatter. Generally, the thickness of the scatter-prevention layer is 0.05 $\mu$m to 1.0 $\mu$m.

A peel-off layer may be provided between the light-heat conversion layer and the image forming layer. By providing a peel-off layer, removing the image forming layer at the time of heat-sensitive transfer recording becomes easier, and a high quality image can be obtained. The peel-off layer can be structured by a heat-fusible compound itself, but ordinarily it is preferable that it is structured of a heat-fusible compound and/or a binder resin or the like such as a thermoplastic resin.

The heat-fusible compound used as the main component of the peel-off layer may be appropriately selected from known compounds and used. Specific examples include the substance disclosed at the upper left column of page 4, line 8 to the upper right column of page 4, line 12 of JP-A No. 63-193886. Specific examples of the thermoplastic resin include ethylene copolymers like ethylene-polyvinyl acetate resins, polyamide resins, polyester resins, polyurethane resins, polyolefin resins, acrylic resins, cellulose resins and the like. In addition to these, resins such as vinyl chloride resins, rosin resins, petroleum resins, ionomer resins and the like, elastomers such as natural rubbers, styrene-butadiene rubbers, isoprene rubbers and chloroprene rubbers, ester gum, rosin derivatives such as rosin-maleic acid resins and rosin-phenol resin, hydrorosins, phenol resins, terpene resins, cyclopentadiene resins and aromatic resins may also be used as needed.

In the present invention, of the various types of thermoplastic resins cited above, a thermoplastic resin generally having a melting point or a softening point within a range of 50° C. to 150° C., and particularly within a range of 60° C. to 120° C., or mixtures of two or more thermoplastic resins which result in a melting point or a softening point within that range may also be suitably used as a component of the peel-off layer.

To produce the heat transfer sheet of the present invention, first, the components forming the respective layers are mixed together while being heated, or are dispersed or dissolved in a solvent to prepare the coating liquids for forming the respective layers. The coating liquids are then sequentially applied to the surface of the support, the solvent is dried as needed, and the heat transfer sheet is obtained.

Examples of solvents for the purpose of preparing the coating liquid include water, alcohol (e.g., ethanol, methanol), cellosolves (e.g., methyl cellosolve, ethyl cellosolve), aromatic compounds (e.g., toluene, xylene, chlorbenzene), ketones (e.g., acetone, methyl ethyl ketone), ester solvents (e.g., ethyl acetate, butyl acetate), ethers (e.g., tetrahydrofuran, dioxane), and chlorine-contained solvents (e.g., chloroform, trichloroethylene).

Conventionally known methods such as a gravure coating method, an extrusion coating method, a wire bar coating method or a roll coating method may be adopted for the coating.

The image forming layer may be formed on the entire surface of the support or a portion thereof as a layer which includes a monochrome color material. The image forming layer may also be formed of a yellow image forming layer having a binder and a yellow colorant, a magenta image forming layer having a binder and a magenta colorant, and a cyan image forming layer having a binder and a cyan colorant, which layers are formed on the entire surface of the support or a portion thereof at a fixed repetition along the planar direction. Further, the image forming layers of these respective colors may also be laminated on top of one another.

By forming a perforation or providing on the heat transfer sheet a detection mark for the purpose of detecting the boundary of layers of different colors, convenience at the time of use can be ensured.

To form an image by receiving the image forming layer which has been separated imagewise from the heat transfer sheet, the material to which the transfer is made is used as a final image recording medium. Ordinarily, the material to which the transfer is made has a support and an image-receiving layer, but sometimes the material to which the transfer is made is formed only of a support.

Because an image forming layer which melts by heat is transferred, it is preferable that the material to which the transfer is made has reasonable heat resistance and excellent dimensional stability such that an image is formed appropriately.

In order to be able to see the image (transmission image) from the surface of the side opposite from the surface having the image which has been transferred, resin films or resin sheets such as polyethylene, polypropylene, polyethylene terephthalate, polystyrene, polyvinyl chloride or polyimide may be used as the support of the material to which the transfer is made. If an image (reflection image) is to be formed which can only be seen from the side of the transfer surface, white color films formed by adding a white color pigment such as barium sulfate, calcium carbonate or titanium oxide to the resin film or the resin sheet, and papers such as coated paper, art paper or RC paper can be used as the support.

When a cushion property is to be given to the support, the support may be formed by a previously cited substance giving a cushion property, or the support may be formed by a complex film or a complex sheet, in which films or sheets formed by a substance which gives a cushion property have been compounded, with a resin film or a resin sheet.

The image-receiving layer can be formed by a binder and various types of additives that are added as needed. When the support does not have a cushion property, a material for the purpose of providing a cushion property may be added to the image-receiving layer.

Examples of the binder include adhesives such as ethylene-vinyl chloride copolymer adhesives, polyvinyl acetate emulsion adhesives, chloroprene adhesives, epoxy resin adhesives, natural rubber, chloroprene rubber, butyl rubber, polyacrylic ester, nitrile rubber, polysulfide rubber, silicone rubber, rosin resin, vinyl chloride resins, petroleum resins and ionomer resins, reclaimed rubber, SBR, polyisoprene and polyvinyl ether.

Rather than providing the support or the image-receiving layer with a cushion property, a cushion layer may be disposed between the support and the image-receiving layer. Because the cushion layer in this case is the same as the cushion layer previously explained in regard to the heat transfer sheet, detailed explanation thereof is omitted. There are no particular limits on the thickness of the support in the material to which the transfer is made having a support, a cushion layer and an image-receiving layer, nor are there any particular limits on the thickness of the support in the material to which the transfer is made formed only of a support. Further, the thickness of the cushion layer is the same as that of the cushion layer in the heat transfer sheet. The thickness of the image-receiving layer is ordinarily 0.1 μm to 20 μm, but is not limited to this when the cushion layer is used as an image-receiving layer.

The surface of the material to which the transfer is made which surface comes into contact with the heat transfer sheet at the time of image formation either has excellent smoothness or is appropriately roughened. When the surface of the image forming layer of the heat transfer sheet is roughened by the addition of mat material or roughening of the cushion layer and the like, it is preferable that the surface of the material to which the transfer is made which comes into contact with the heat transfer sheet has an excellent smoothness. When the image forming layer is not roughened, it is preferable that the surface of the material to which the transfer is made which comes into contact with the heat transfer sheet is roughened by the addition of mat material and the roughening of the cushion layer. The image forming layer and the surface of the material to which the transfer is made which comes into contact with the image forming layer may also both be roughened. When neither the heat transfer sheet nor the material to which the transfer is made are roughened, it is preferable to subject the material to which the transfer is made having a cushion layer to a roughening treatment just before the two are adhered together, and then smooth again the roughened area in a state in which the two are vacuum-adhered.

The mat material is the same as the mat material described in the explanation regarding the heat transfer sheet. Therefore, detailed description thereof is omitted. By using a mat material which is crushed by pressure applied thereto or by heat and pressure applied thereto, a cushion layer, or a support having a cushion property and an image-receiving layer, do not have to be used in the material to which the transfer is made. This is the same as the case in which such a mat material is used in the heat transfer sheet.

By using a mat material in the heat transfer sheet or the material to which the transfer is made, drawbacks resulting from the contact surfaces of the heat transfer sheet and the material to which the transfer is made being appropriately roughened and over-adhering to one another can be eliminated. On the other hand, by endowing the material to which the transfer is made with a cushion property, drawbacks arising from using a mat material, namely adhesive irregularity, deterioration in resolution, color fog and the like are eliminated.

As mentioned above, the material on which an image is transferred and formed by the heat transfer sheet can be utilized as a final image recording medium.

When a multicolor or full color transfer image is formed by using various types of heat transfer sheets having color materials of respectively different colors and one sheet of the material to which the transfer is made, and by repeating imagewise transfer of monochrome image forming layers, it is necessary that the material to which the transfer is made has a cushion property. In particular, it is preferable that a support having a cushion property or a cushion layer be formed by a restorable shape-memory resin. Examples of the shape-memory resin include those previously cited.

In general, when the image forming layer is transferred imagewise by the heat transfer sheet to the material to which the transfer is made, it is preferable that the surface of the material to which the transfer is made be smooth in order to obtain a transfer image having a high image quality. In other words, a high-quality image cannot be recorded if the surface of the material to which the transfer is made has a low level of smoothness.

Therefore, to form a high-quality image on the material to which the transfer is made whose surface has a low level of smoothness, it is preferable to first transfer the image to an intermediate transfer material, whose surface has a high level of smoothness, serving as the material to which the transfer is made and then transfer the image of the intermediate transfer material to the material to which the transfer is made having a surface whose level of smoothness is low.

The intermediate transfer material can take the same structure as that of the material to which the transfer is made. However, it is necessary that the intermediate transfer material has a cushion property. Further, it is not necessary to roughen the intermediate transfer material.

When the intermediate transfer material has a cushion layer and a wood-free paper is used as a support, the thickness of the cushion layer is preferably at least 20 μm or higher, because the wood-free paper has an unevenness of 10 μm to 20 μm.

In the intermediate transfer material, it is preferable that the receptivity of the image forming layer is excellent, and that the re-transferability to the final material to which the transfer is made is excellent. Examples of the intermediate transfer material having such characteristics include polyethylene, polypropylene, low VA-type ethylene-vinyl acetate copolymer, ethylene-ethyl acrylate copolymer (EEA), ethylene-methacrylate copolymer (EMA), ethylene-methyl methacrylate (EMMA), ethylene-vinyl acetate copolymer, ionomer resin, chlorinated ethylene, chlorinated polypropylene, chlorinated polyolefin, butadiene rubber, isoprene rubber, SBR, SBS, SIP, polyvinyl butyral, polyvinyl acetal, polyvinyl ether, polyvinyl alcohol, polyvinyl pyrolidone, olefin polymers such as various types of acrylate resins, polyester resins, polyurethane resins, polyamide resins, cellulose such as nitrocellulose, acetic cellulose and ethyl cellulose, fluorine-contained resins and silicone resins.

By overlapping the intermediate transfer material and the final material to which the transfer is made and then applying pressure or heat and pressure thereto, the image of the intermediate transfer material is re-transferred to the surface of the final material to which the transfer is made.

When a monochrome image is to be re-transferred, a material to which the transfer is made (i.e., the intermediate transfer material) and a final material to which the transfer is made are used. When a multicolor image or a full-color re-transfer image is formed on the final material to which the transfer is made, a plurality of intermediate transfer materials may be used with respect to one final material to which the transfer is made. Alternatively, a multicolor or full-color transfer image formed on one intermediate transfer material can be re-transferred to the final material to which the transfer is made.

Whether a monochrome image is re-transferred or a multicolor or full-color image is re-transferred, any one of a procedure in which the entire image-receiving layer of the intermediate transfer material is re-transferred to the final material to which the transfer is made and a procedure in which the transfer image on the intermediate transfer material is re-transferred without transferring the image-receiving layer of the intermediate transfer material may be employed.

When an image alone is transferred without transferring the image-receiving layer, it is preferable that the image-receiving layer in the intermediate transfer material is non-adhesive with respect to the final material to which the transfer is made.

When carrying out re-transfer while heat is applied, it is preferable that the image-receiving layer in the intermediate transfer material does not have a heat-sealing capacity at the time of the re-transfer. When a procedure is adopted in which re-transfer is conducted while heat is applied, it is necessary to employ a means such that the image-receiving layer in the intermediate transfer material and the cushion layer are not easily separated by the heat (e.g., intervening an adhesion layer between the image-receiving layer and the cushion layer or the like).

When the image is re-transferred together with the image-receiving layer of the intermediate transfer material, in contrast to the above, it is preferable to dispose a peel-off layer between the image-receiving layer and the cushion layer.

The intermediate transfer material and the material to which the transfer is made which have a cushion layer and an image-receiving layer on a support can be obtained by mixing together the respective components forming the respective layers while heat is applied thereto, or by dispersing or dissolving the components in a solvent to prepare the coating liquids for forming the respective layers, then applying the coating liquids to the surface of the support, drying the solvent as needed, and repeating the process.

Examples of solvents used in the coating include water, alcohol (e.g., ethanol, propanol), cellosolves (e.g., methyl cellosolve, ethyl cellosolve), aromatic compounds (e.g., toluene, xylene, chlorobenzene), ketones (e.g., acetone, methyl ethyl ketone), ester solvents (e.g., ethyl acetate, butyl acetate), ethers (e.g., tetrahydrofuran, dioxane), and chlorine-contained solvents (e.g., methylene chloride, chloroform, trichloroethylene).

Conventionally known methods such as a gravure coating method, an extrusion coating method, a wire bar coating method or a roll coating method may be adopted for the coating. In addition to these coating methods, the image-receiving layer can be formed by a hot melt extrusion lamination method in which the mixture containing the components of the image-receiving layer are molten-extruded and laminated.

Lamination using the hot melt extrusion lamination method can be carried out in accordance with common methods disclosed in JP-A No. 1-263081, JP-A No. 1-271289, JP-A No. 2-106397, JP-A No. 2-111586, JP-A No. 2-305688 and JP-A No. 3-49991.

A heat transfer recording method in which a monochrome image is formed using the heat transfer sheet of the present invention is carried out in the following manner. First, the heat transfer sheet and the material to which the transfer is made are overlaid and disposed on a substrate. In this case, it does not matter which of the heat transfer sheet and the material to which the transfer is made is disposed first on the substrate.

A cylindrical drum or a flat substrate can be used as the substrate. However, a cylindrical drum is preferred because when a cylindrical drum is used as the substrate, a transfer image can be formed at a high speed by high speed revolution, space used in light irradiation can be made smaller, and when using laser light or the like by simplifying the optical system, energy efficiency can be raised and the apparatus can be made compact.

At this time, the heat transfer sheet and/or the material to which the transfer is made are adhered to the substrate. There are no particular restrictions on the means by which the heat transfer sheet and the material to which the transfer is made are adhered. For example, a plurality of penetration holes may be provided in the substrate, and air may be exhausted by an exhaustion means from the penetration holes whereby the heat transfer sheet or the material to which the transfer is made are fixed by the suction force resulting from the exhaustion.

At the time of adhesion, in order to raise the adherability between the heat transfer sheet and the material to which the transfer is made, a cover sheet may be disposed on the laminate of the heat transfer sheet and the material to which the transfer is made, or the size of one of the heat transfer sheet and the material to which the transfer is made which one is detached from the substrate can be made a little larger than the size of another which is adjacent to the substrate, as needed.

Japanese Utility Model Application Laid-Open (JP-U) No. 63-87031 discloses a method of separately adhering and separating two sheets.

In order to shorten the time necessary to complete adhesion of the sheets, it is preferable to reduce the pressure applied to the heat transfer sheet and the material to which the transfer is made while squeezing them. Further, in a case in which at least one of the heat transfer sheet and the material to which the transfer is made has a cushion layer, after the two are adhered together by squeezing them while the pressure is reduced, the degree of vacuum necessary to support adhesion may be small. Accordingly, once a degree of vacuum is sufficiently raised in the adhesion process, the sufficient degree of vacuum at the time of recording is not particularly necessary, which becomes advantageous from the standpoint of device design.

The degree of vacuum required for vacuum adhesion varies in accordance with the degree to which the surface of the heat transfer sheet and the material to which the transfer is made is roughened, but is 0.1 torr to 350 torr and may be lowered after adhesion is completed. The pressure which is applied to the laminate of the heat transfer sheet and the material to which the transfer is made to which the mat material has been mixed is ordinarily 0.1 $kg/cm^2$ to 5 $kg/cm^2$. In this case, when a mat material having a small particle diameter is used, the pressure applied thereto may be small. Conversely, when a mat material having a large particle diameter is used, it is necessary to increase the pressure applied thereto.

After the laminate is adhered to the substrate, light (e.g., laser light) is irradiated imagewise from the reverse side of the substrate if the substrate is transparent or the cover sheet side. Laser light is converted to heat by the infrared absorption colorants inside the heat transfer sheet, and the image forming layer is melted imagewise and adhered to the material to which the transfer is made. Thereafter, when the heat transfer sheet and the material to which the transfer is made are separated, the material to which the transfer is made to which a monochrome image has been adhered imagewise is obtained.

A multicolor image or full-color image is obtained by the following.

First, a heat transfer sheet is prepared which is formed of a cyanogen image forming layer, a magenta image forming layer and a yellow image forming layer provided sequentially on a support. Or, a monochrome heat transfer sheet having a cyanogen image forming layer on a support, a monochrome heat transfer sheet having a magenta image forming layer on a support and a monochrome image forming layer having a yellow image forming layer on a support are prepared.

Next, the material to which the transfer is made is fixed on the substrate by a suction action, and the heat transfer sheet is overlaid thereon. When a full-color image or a multicolor image is to be formed, it is necessary to exchange heat transfer sheets many times in a state in which the material to which the transfer is made is adhered on the substrate. Therefore, in order to form an image in a short amount of time, it is more preferable to not use a cover sheet.

As stated previously, light is irradiated imagewise and an image (e.g., a cyanogen image) is formed on the surface of the material to which the transfer is made, and the heat transfer sheet is separated from the surface of the material to which the transfer is made. Next, heat transfer sheets of different colors are overlaid on the material to which the transfer is made and, similar to the above, light is irradiated imagewise and another image (e.g., a magenta image) is formed. After the image is formed, the heat transfer sheet is separated from the material to which the transfer is made and other different colored heat transfer sheets are overlaid on the material to which the transfer is made. Next, light is irradiated imagewise and still another image (e.g., a yellow image) is formed.

While the plurality of heat transfer sheets are exchanged, it is necessary to fix on the substrate the material to which the transfer is made so as to align respective images whose colors are different from one another. For this reason, it is preferable that the surface of the substrate is formed of an adhesive material and that, at the time the heat transfer sheets are replaced, the material to which the transfer is made is fixed on the substrate by a suction force resulting from exhaust.

Further, when the material to which the transfer is made has a cushion layer formed by a shape-memory resin, the temperature of the cushion layer is raised for each one color that is transferred and that shape is recovered.

When an image is transferred to the intermediate transfer material, the method described above can be used. By using the intermediate transfer material having an image on the surface thereof, a precise image can be formed even on the material to which the transfer is made which does not have a smooth surface.

EXAMPLES

The present invention is hereinafter described on the basis of Examples. However, the present invention is not limited to these Examples. Unless otherwise specified, "parts" indicate parts by weight.

Example 1

(1) Preparation of Light-Heat Conversion Layer Coating Liquid

The light-heat conversion layer coating liquid was prepared by mixing the following respective components while the components were stirred with a stirrer.

| Coating liquid composition | |
|---|---|
| light-heat conversion substance (infrared absorption colorant I-13) | 20 parts |
| light-heat conversion substance (infrared absorption colorant I-14) | 10 parts |
| light-heat conversion substance (infrared absorption colorant I-15) | 30 parts |
| polyimide resin (Rikacoat SN-20, manufactured by New Japan Chemical Co., Ltd.) | 200 parts |
| N-methyl-2-pyrolidone | 2000 parts |
| surfactant (Megafac F-177, manufactured by Dainippon Ink & Chemicals, Inc.) | 1 part |

I-13

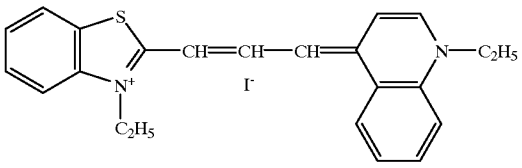

I-14

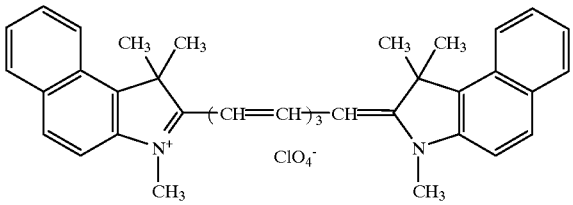

I-15

-continued

| Coating liquid composition |
|---|
| 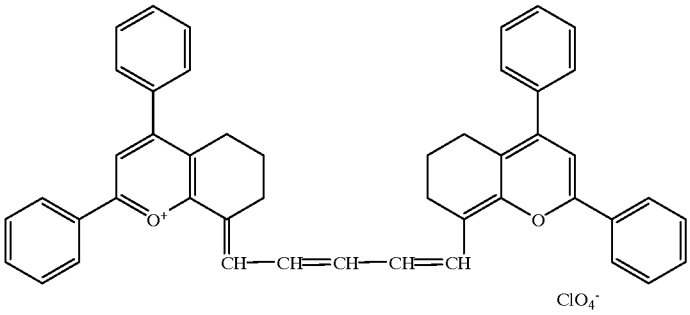 |

(2) Formation of Light-Heat Conversion Layer on Support Surface

After the coating liquid was applied using a rotary coater (a spincoater) on one surface of polyethylene terephthalate film having a thickness of 100 μm, the film was dried for two minutes in an oven at 100° C., and a light-heat conversion layer was formed on the support. The obtained light-heat conversion layer had an absorption maximum in the vicinity of 830 nm at a wavelength within a range of 700 nm to 1000 nm, and when the absorbancy (optical density, or OD) was measured with a Macbeth densitometer, the OD was 1.0. The film thickness was on average 0.31 μm when the cross section of the light-heat conversion layer was inspected with a scanning electron microscope.

(3) Preparation of Yellow Image Forming Layer Coating Liquid

The yellow pigment dispersion mother liquor was prepared by dispersing with a paint shaker (manufactured by Toyo Seiki, Ltd.) the following components for two hours and thereafter removing the glass beads.

| | |
|---|---|
| Pigment dispersion mother liquor composition | 12.6 parts |
| 20 wt. % of solution of polyvinyl butyral (manufactured by Denki Kagaku Kogyo K.K., Denka butyral #2000-L, Vicat softening point 57° C.) | |
| color material (yellow pigment (C.I. PY. 14)) | 24 parts |
| dispersion assistant (Solsperse S-20000, manufactured by ICI, Ltd.) | 0.8 parts |
| n-propyl alcohol | 110 parts |
| glass beads | 100 parts |

The yellow image forming layer coating liquid was prepared by mixing the following components while the components were stirred with a stirrer.

Coating liquid composition

| | |
|---|---|
| Above pigment dispersion mother liquid | 20 parts |
| n-propyl alcohol | 60 parts |
| surfactant | 0.05 parts |

(Megafac F-176PF, manufactured by Dainippon Ink & Chemicals, Inc.)

(4) Formation of Yellow Image Forming Layer on Light-Heat Conversion Layer Surface After the coating liquid was applied using a spincoater on the surface of the light-heat conversion layer for one minute, the coated layer was dried for two minutes in an oven at 100° C., and the yellow image forming layer (pigment 64.2 wt. %, polyvinyl butyral 33.7 wt. %) was formed on the light-heat conversion layer. When the absorbancy (optical density, or OD) of the obtained image forming layer was measured with a Macbeth densitometer the OD was 0.7. The film thickness was on average 0.4 μm when similarly measured. A heat transfer sheet provided with a light-heat conversion layer and a yellow image forming layer sequentially disposed on a support was thus prepared in accordance with the above process.

Example 2

A heat transfer sheet was prepared in the same manner as that of Example 1, except that the light-heat conversion substances were altered to the following infrared absorption colorants: I-16 (20 parts), I-17 (15 parts) and I-18 (30 parts).

I-16

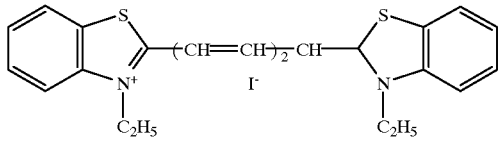

I-17

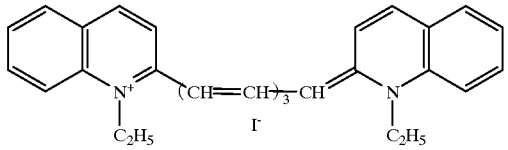

I-18

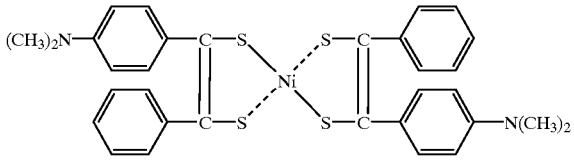

Comparative Example 1

A heat transfer sheet was prepared in the same manner as that of Example 1, except that the light-heat conversion substances were altered to carbon black (manufactured by Mitsubishi Chemical Corp., MA-100), 50 parts.

Comparative Example 2

A heat transfer sheet was prepared in the same manner as that of Example 1, except that the light-heat conversion substances were altered to infrared absorption colorant I-14, 15 parts.

Comparative Example 3

A heat transfer sheet was prepared in the same manner as that of Example 1, except that the light-heat conversion substances were altered to infrared absorption colorants: I-13 (27 parts), I-14 (15 parts) and I-15 (40 parts).

Production of Material to which the Transfer is Made (1) Preparation of First Image-Receiving Coating Liquid A first image-receiving layer coating liquid was prepared by mixing the following respective components while the components were stirred with a stirrer.

| Coating liquid composition | |
|---|---|
| polyvinyl chloride (Zeon 25, manufactured by Zeon Corp.) | 9 parts |
| surfactant (Megafac F-177P, manufactured by Dainippon Ink & Chemicals, Inc.) | 0.1 parts |
| methyl ethyl ketone | 130 parts |
| toluene | 35 parts |
| cyclohexanone | 20 parts |
| dimethylformamide | 20 parts |

(2) Formation of First Image-Receiving Layer on Support Surface

After the above coating liquid was applied using a spin-coater on one side of a surface of the support (polyethylene terephthalate film having a thickness of 75 μm), the film was dried for two minutes in an oven at 100° C., and a first image-receiving layer was formed on the support.

(3) Preparation of Second Image-Receiving Layer

A second image-receiving layer was prepared by mixing the following components while the components were stirred by a stirrer.

| Coating liquid composition | |
|---|---|
| methyl metacrylate/ethyl acrylate/ methacrylic acid terpolymer (Dianal BR-77, manufactured by Mitsubishi Rayon Co., Ltd.) | 17 parts |
| alkyl acrylate/alkyl metacrylate copolymer (Dianal BR-64, manufactured by Mitsubishi Rayon Co., Ltd.) | 17 parts |
| pentaerythritol tetraacrylate (A-TMMT, manufactured by Shin Nakamura Kagaku, Ltd.) | 22 parts |
| surfactant (Megafac F-177P, manufactured by Dainippon Ink & Chemicals, Inc.) | 0.4 parts |
| methyl ethyl ketone | 100 parts |
| hydroquinone monomethyl ether | 0.05 parts |
| 2,2-dimethoxy-2-phenylacetophenone | 1.5 parts |

(4) Second Image-Receiving Layer Formation on First Image-Receiving Layer Surface After the above coating liquid was applied using a spin-coater on one the surface of the first image-receiving layer on the support, the coated layer was dried for two minutes in an oven at 100° C., and a second image-receiving layer (thickness of 26 μm) was formed on the first image-receiving layer. The material to which the transfer is made, in which two image-receiving layers were laminated on a support, was thus produced in accordance with the above process.

Production of Laminate

A laminate was produced by overlaying the second image-receiving layer of the material to which the transfer is made and the image forming layer of the heat transfer sheet.

Evaluation (1) Sensitivity Measurement

On a rotary drum provided with holes for vacuum adsorption, the laminate was coiled such that the surface side of the material to which the transfer is made came into contact with the drum surface, and the laminate was fixed to the drum surface by the drum interior being made into a vacuum. The drum was rotated, and a semiconductor laser light was converged from an outer side to the surface of the laminate on the drum such that the light converged into a spot having a diameter of 7 μm at the surface of the light-heat conversion layer. The light was then moved (sub-scanning) in a right-angle direction with respect to the direction of rotation (main scanning direction) of the rotary drum, and laser image (image line) recording was conducted on the laminate. The laser irradiation conditions were as follows.

laser power: 110 mW main scanning speed: 4 m/second sub-scanning pitch (sub-scanning amount per rotation): 20 μm The laminate, on which laser image recording was carried out, was taken off of the drum. When the material to which the transfer is made and the heat transfer sheet were peeled off by hand, it was confirmed that only the laser-irradiated portion of the image (image line) forming layer had been transferred from the heat transfer sheet to the material to which the transfer was made. The transfer image was inspected with an optical microscope and the laser-irradiated portion had been linearly recorded. The recorded line width was measured and the sensitivity was determined using the formula below. The results are shown in Table 1.

$$\text{sensitivity}=(\text{laser power } P)/(\text{line width } d \times \text{line speed } v)$$

(2) Fogging Evaluation

A solid image was recorded in the same manner as described above, except that sub-scanning pitch was altered to 10 μm so that the beam lines overlapped. The yellow fogging in the transfer image was judged with the eye according to the criteria below. The results are shown in Table 1.

TABLE 1

| | Light-Heat Conversion | Optical Density (600 nm–1100 nm) | | Sensitivity (mJ/cm$^2$) | | | Fogging Evaluation | | |
|---|---|---|---|---|---|---|---|---|---|
| | Substance | min. | max. | laser 1 | laser 2 | laser 3 | laser 1 | laser 2 | laser 3 |
| Example 1 | I-13, I-14, I-15 | 0.35 | 1.85 | 265 | 260 | 285 | ○ | ○ | ○ |
| Example 2 | I-16, I-17, I-18 | 0.40 | 1.75 | 240 | 225 | 260 | ○ | ○ | ○ |
| Comparative Example 1 | carbon black | 0.65 | 1.05 | 330 | 310 | 360 | XX | XX | XX |
| Comparative Example 2 | I-14 | 0.01 | 1.20 | not recorded | 275 | not recorded | evaluation impossible | ○ | evaluation impossible |
| Comparative Example 3 | I-13, I-14, I-15 | 0.95 | 2.35 | 260 | 250 | 280 | X | XX | ○ |

⊙ no fogging
○ good
Δ inconspicuous, but fogging present
X fogging of the orange color
XX fogging of the green color
Laser 1: 655 nm semiconductor laser
Laser 2: 830 nm semiconductor laser
Laser 3: 1064 nm semiconductor laser The heat transfer sheets of the Examples were able to be used for a laser recording device having a range wider than that of Comparative Example 2. Furthers the heat transfer sheets of the Examples showed better results in terms of fogging than those of Comparative Examples 1 and 3.

What is claimed is:

1. A heat transfer sheet comprising a light-heat conversion layer having an infrared absorption colorant and an image forming layer sequentially disposed on a support, wherein an optical density in a 600 nm to 1000 nm range of the light-heat conversion layer is within a range of 0.3 to 2.0, wherein the light-heat conversion layer includes a binder, and wherein the binder is a polyimide resin.

2. The heat transfer sheet according to claim 1, wherein the light-heat conversion layer has at least two or more infrared absorption colorants.

3. The heat transfer sheet according to claim 2, wherein the image forming layer includes a pigment in an amount of 20 wt. % to 80 wt. % and an amorphous organic polymer in an amount of 20 wt. % to 80 wt. %, the polymer having a softening point in a temperature range of 40° C. to 150° C., and the image forming layer having a thickness from 0.2 $\mu$m to 1.5 $\mu$m.

4. The heat transfer sheet according to claim 3, wherein the light-heat conversion layer has a thickness from 0.1 $\mu$m to 3 $\mu$m.

5. The heat transfer sheet according to claim 3, wherein the amorphous organic polymer is a polyvinyl butyral.

6. The heat transfer sheet according to claim 2, wherein the infrared absorption colorants are combinations of the following substances:

I-13

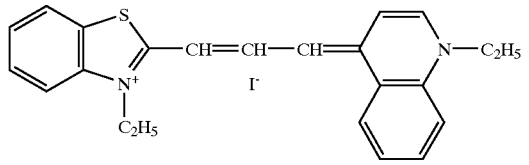

I-14

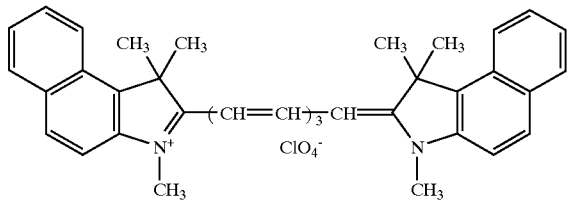

I-15

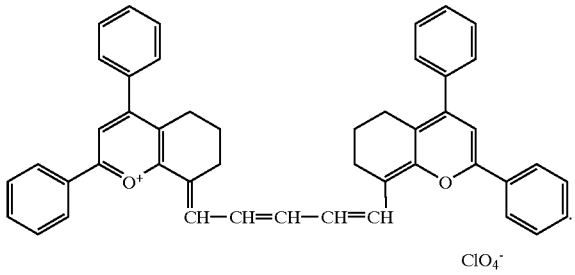

7. The heat transfer sheet according to claim 6, wherein the amorphous organic polymer is a polyvinyl butyral.

8. The heat transfer sheet according to claim 2, wherein the infrared absorption colorants are combinations of the following substances:

I-16

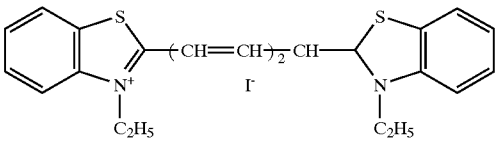

I-17

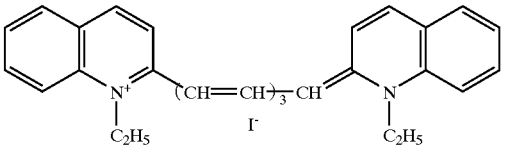

I-18

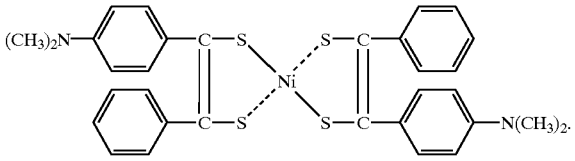

9. The heat transfer sheet according to claim 8, wherein the amorphous organic polymer is a polyvinyl butyral.

10. The heat transfer sheet according to claim 1, wherein the image forming layer includes a pigment in an amount of 20 wt. % to 80 wt. % and an amorphous organic polymer in an amount of 20 wt. % to 80 wt. %, the polymer having a softening point in a temperature range of 40° C. to 150° C., and the image forming layer having a thickness from 0.2 $\mu$m to 1.5 $\mu$m.

11. The heat transfer sheet according to claim 10, wherein the light-heat conversion layer has a thickness from 0.1 $\mu$m to 3 $\mu$m.

12. The heat transfer sheet according to claim 10, wherein the amorphous organic polymer is a polyvinyl butyral.

13. The heat transfer sheet according to claim 1, wherein the light-heat conversion layer has a thickness from 0.1 $\mu$m to 3 $\mu$m.

* * * * *